US005226919A

United States Patent [19]

Milligan

[11] Patent Number: 5,226,919

[45] Date of Patent: Jul. 13, 1993

[54] WINDOW GRILLE RETAINER

[75] Inventor: Patrick E. Milligan, Kendall, N.Y.

[73] Assignee: Caldwell Manufacturing Company, Rochester, N.Y.

[21] Appl. No.: 916,475

[22] Filed: Jul. 17, 1992

Related U.S. Application Data

[63] Continuation-in-part of Ser. No. 689,308, Apr. 22, 1991, abandoned.

[51] Int. Cl.[5] ..... E04C 2/38

[52] U.S. Cl. ..... 52/314; 52/656.8

[58] Field of Search ..... 52/311, 314, 455, 456, 52/656, 311.3, 656.8, 314

[56] References Cited

U.S. PATENT DOCUMENTS 3,254,465 6/1966 Brengman et al. .
3,293,817 12/1966 MacGregor .
3,504,468 4/1970 Martin .
4,644,721 2/1987 Bloomquist et al. .
4,665,663 5/1987 Governale .
4,854,100 8/1989 LaSee .

OTHER PUBLICATIONS

"Installation Instruction Sheet", Andersen Corporation Bayport, MN, 55003, Apr. 9, 1989.

*Primary Examiner*—Richard E. Chilcot, Jr.
*Attorney, Agent, or Firm*—Eugene Stephens & Associates

[57] ABSTRACT

A window grille retaining system includes a two-piece spring clip assembly. One of the pieces is formed as a pin that is carried within a slot formed in a bottom surface of the grille molding. The other piece is formed as a bracket having a first arm that is formed as a blade for anchoring the bracket to a window sash and a second arm that is formed as a spring clip. Fingers are formed in the spring clip for engaging the pin with a snap-type engagement. The spring clip arm is spaced from the sash so that the fingers can engage the pin in different positions along the length of the pin to accommodate variation in the lengths of the grille molding.

32 Claims, 3 Drawing Sheets

WINDOW GRILLE RETAINER

RELATED APPLICATIONS

This application is a continuation-in-part of copending parent application Ser. No. 689,308, filed Apr. 22, 1991, entitled WINDOW GRILLE RETAINER, now abandoned. The parent application is hereby incorporated by reference.

BACKGROUND

Window grilles divide a single windowpane into a number of smaller panes or "lights". The grilles are made by interlocking pieces of molding in a pattern that defines a desired shape of the smaller panes. In this way, standard window sashes can be converted into a variety of different style windows including colonial, tutor, and victorian styles. For convenience, the grilles are attached on the inside of window sashes with temporary retaining devices so that the grilles can be easily removed to clean the underlying pane or to refurbish the grille.

A variety of different retaining systems have been used to attach the grilles to window sashes. Most of the systems include blades with pointed ends that are pushed into the window sashes or into glazing material sealing the panes to the sashes. The systems differ from one another by the way in which the blades are attached to ends of the grille molding.

For example, one known grille retaining system includes slots formed in the molding ends for receiving the blades. The slots permit the blades to slide back and forth along a limited length of the molding for engaging and disengaging the pointed ends of the blades with the window sash. Each of the blades includes, in addition to a blade body, a pair of tabs that are bent at right angles to the blade body against sides of the molding. The tabs guide the blade bodies along the slots and provide a grip for pushing the pointed ends of the blades into the window sash.

After the blades have been engaged with the sash a few times, holes formed by the blades in the sash become enlarged and exert less restraint on the blades. Vibrations from wind against the sashes or from opening and closing the windows can shake loose the blades from the sashes and allow the grilles to fall out of the windows. Also, when the grilles are removed from the windows, the pointed end of the blades may project from the molding ends, making the grilles dangerous to handle.

Another known grille retaining system permanently anchors the pointed end of the blades in the glazing material between the windowpane and sash. The blades are bent in the shape of a bracket having two arms. One of the arms forms a blade body and the other arm projects away from the pane. The arm that projects from the pane includes a boss that resiliently engages a notch formed in the end of the grille molding. The boss, together with the notch, functions as a detent for securing the grille to the window and for releasing the grille from the window.

However, this type of grille retaining system is known to be overly sensitive to dimensions of the grille molding. The detent arm of the blades has only a limited range of angular movement with which to engage the notches in the molding, and normal variations in the length of the molding sometimes exceeds this range. For example, if the molding is a little short, the detent arm may not engage the notch at the end of the molding with enough pressure to hold the grille in place. Adjustments are made by bending the detent arms toward or away from the window sash to match variations in the lengths of molding. These "trial and error" adjustments of each detent arm are time consuming and inconvenient.

Another known bracket for retaining window grilles includes the usual blade body that is permanently anchored in the window glazing material, but also includes a pair of resilient arms that are bent at substantially right angles from opposite sides of the blade body. Each of the resilient arms includes a boss formed on their outer surface near their end that projects from the windowpane. Slots are formed in a bottom surface of the molding adjacent to the windowpane for receiving the blade arms, and the slots are undercut along their length to capture the two bosses of each bracket between them.

Although this known retaining system allows some adjustability for engaging variable lengths of the grille molding, the slots must be formed with exceptional accuracy to maintain firm engagement with the resilient arms and to properly position the window grilles against the windowpanes. The slots are also sensitive to wear, particularly splintering at the ends of the molding, that can prevent the bosses from fully engaging the undercut portions of the slots.

The grill retaining systems that force blades between windowpanes and sashes also add a risk of damaging the windowpanes. Some of the blades are likely to engage the windowpanes by pressing against edges of the panes. Stress occurs at these points of engagement and sometimes cracks or chips the windowpanes.

SUMMARY OF THE INVENTION

My new window grille retaining system overcomes the above-identified problems with prior systems and provides a more positive interlock for attaching window grilles to sashes. Instead of using a single retaining piece that is either carried by the molding or permanently anchored to the window sash, my invention includes two pieces, one of which is carried by the molding and the other is permanently anchored to the window sash.

The piece that is anchored may be formed as a bracket having two arms joined at a right angle to each other. One of the arms is formed as a blade that can be pushed into the sash or into the glazing material between the windowpane and sash. The other arm is formed as a spring clip having two resilient fingers that project from the windowpane. The two fingers are separated by a slit that preferably extends through the angled joint between the two arms and part way through the length of the blade arm.

The other piece that is carried by the molding may be formed as a pin that is mounted within a slot in the bottom surface of the molding adjacent to the windowpane. The slot extends, from an end face of the molding, a predetermined distance along the length of the molding. The pin preferably takes the form of a nail having a shaft that is driven through the slot until a head of the nail is flush with the end face of the molding. One portion of the shaft length is permanently anchored in the molding, and the remaining length of the shaft is exposed through the bottom surface of the molding.

The two pieces of my grille retainer cooperate to form a spring clip assembly for positively interlocking the grille molding and window sash. Outer edges of the resilient fingers are tapered to guide the spring clip into the slot formed in the bottom surface of the molding. Opposing notches are formed between the fingers for engaging the nail shaft along any of the portion of its length that is exposed through the bottom surface of the molding. The notches are dimensioned with respect to the slit between the fingers and a diameter of the nail shaft to embrace the nail shaft with a positive "snap-type" engagement.

Since the spring clip is engageable along the exposed length of the nail, my retaining system is not sensitive to ordinary variations in the length of grille molding. The spring clip and nail shaft are engaged by a resilient reaction force opposing their separation in a plane that extends perpendicular to the length of the molding. Accordingly, the spring clip assembly exerts the same spring force along any portion of the exposed length of the nail. However, the spring force is set so that the grille can be readily unsnapped from the spring clip arm by a predetermined manual force directed away from the windowpane.

The slots formed in the bottom surface of the molding merely provide a clearance space for engaging the pin piece. Accordingly, it is not necessary to form the slots with any degree of accuracy beyond that required for clearance purposes. Also, the slots are not sensitive to wear that would otherwise affect their limited function in the retaining system.

The blade arms can be formed with two parallel portions that are offset with respect to each other to reduce the risk of damaging the windowpanes. The first portion is shaped for engaging the window sash, and the second portion is spaced from the first portion by a predetermined amount for guiding the first portion into engagement with the window sash at the predetermined spacing from the windowpane. The first and second portions are joined by a third portion that forms a stop for limiting penetration of the first portion into the window sash.

A novel tool is also provided for guiding the spring clip into engagement with the window sash at the predetermined spacing from the windowpane.

My grille retaining system can be used to install a grille to an existing window by forming, in the bottom surface of the grille molding, slots that extend through end faces of molding. Pins are inserted into the ends of the molding so that a portion of the length of the respective pins is exposed within the slots. Blade arms of brackets are aligned with intersections between the ends of the molding and the sash, and the blade arms are then pushed into engagement with the sash leaving a predetermined space between a spring clip arm of the bracket and the window sash. The blade arms are shaped to limit movement of the blades into the sash. The ends of the molding are pushed toward the windowpane until the spring clip arms of the brackets positively interlock with a portion of the exposed length of the pins in a snap-type engagement.

DRAWINGS

DETAILED DESCRIPTION

Figure 1:
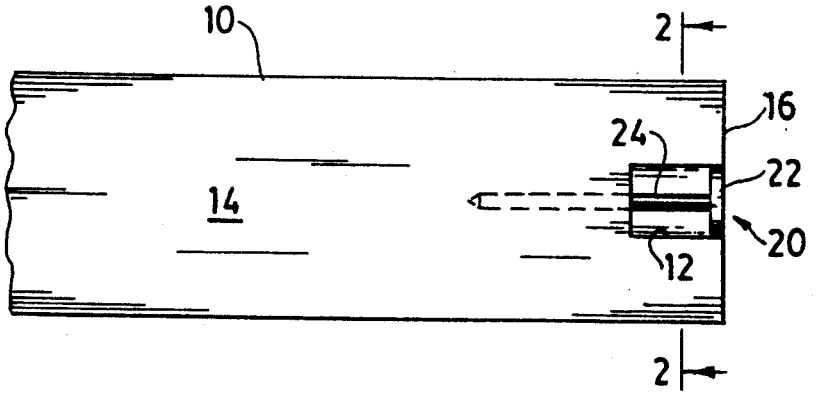
FIG. 1 is a bottom view of a cut-off piece of grille molding having formed at one end a slot that exposes part of a length of a nail driven into the end of the molding.
Figure 2:
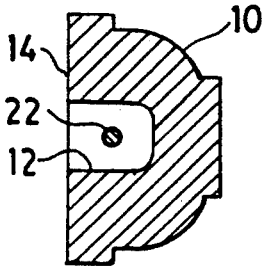
FIG. 2 is a cross-sectional view taken along line 2—2 of FIG. 1 showing the sectioned length of the nail centered within the slot.
Figure 3:
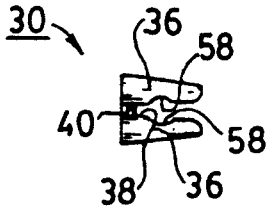
FIG. 3 is a top view of a bracket piece showing a blade arm of the piece.
Figure 4:
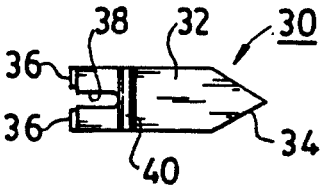
FIG. 4 is an end view of the bracket piece showing a spring clip arm of the piece.
Figure 5:
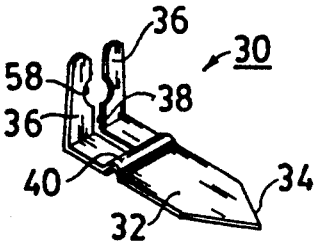
FIG. 5 is a perspective view of the bracket piece showing both arms of the piece.

A first embodiment of my invention is illustrated by FIGS. 1-7. In FIG. 1, there is shown a cut-off piece of molding that is part of a window grille. A cross section of the molding 10 is shown in FIG. 2. The two figures show respective orthogonal views of a slot 12 that is formed in a bottom surface 14 of the molding. The slot 12 forms an opening in end face 16 of the molding and extends from the end face 16 a short distance along the length of the molding 10.

A pin 20, which takes the form of a nail in the illustrated embodiment, includes a head 22 on an end of a shaft 24 that is driven into the end face 16 of the molding within the slot 12. The head 22, shown flush with the end face 16 of the molding, provides a means for driving the pin 20 into the molding. However, only a portion of the length of the shaft 24, shown in phantom line, is driven into the molding. The remaining portion of the shaft 24 is exposed within the slot 12. The exposed portion of shaft 24 is also centered within the slot for providing clearance from the slot 12 about its circumference.

The pin 20 defines one piece of a two-piece spring clip assembly. The other piece is defined by a bracket designated generally at 30. The bracket 30 is made of a resilient material, such as sheet metal, that is bent to a right angle for dividing the bracket into two arms. One of the arms is formed as a blade 32 having a pointed end 34. The other arm is formed as a spring clip having two fingers 36 that are separated by a slit 38. The two fingers 36 are made more flexible by extending the slit 38 through the right angle bend in the bracket into a part of the blade 32. However, the two fingers also exhibit sufficient resilience to spring back quickly into shape after being separated. The slit 38 terminates in the vicinity of a boss 40 that extends across the blade 32.

Figure 6:
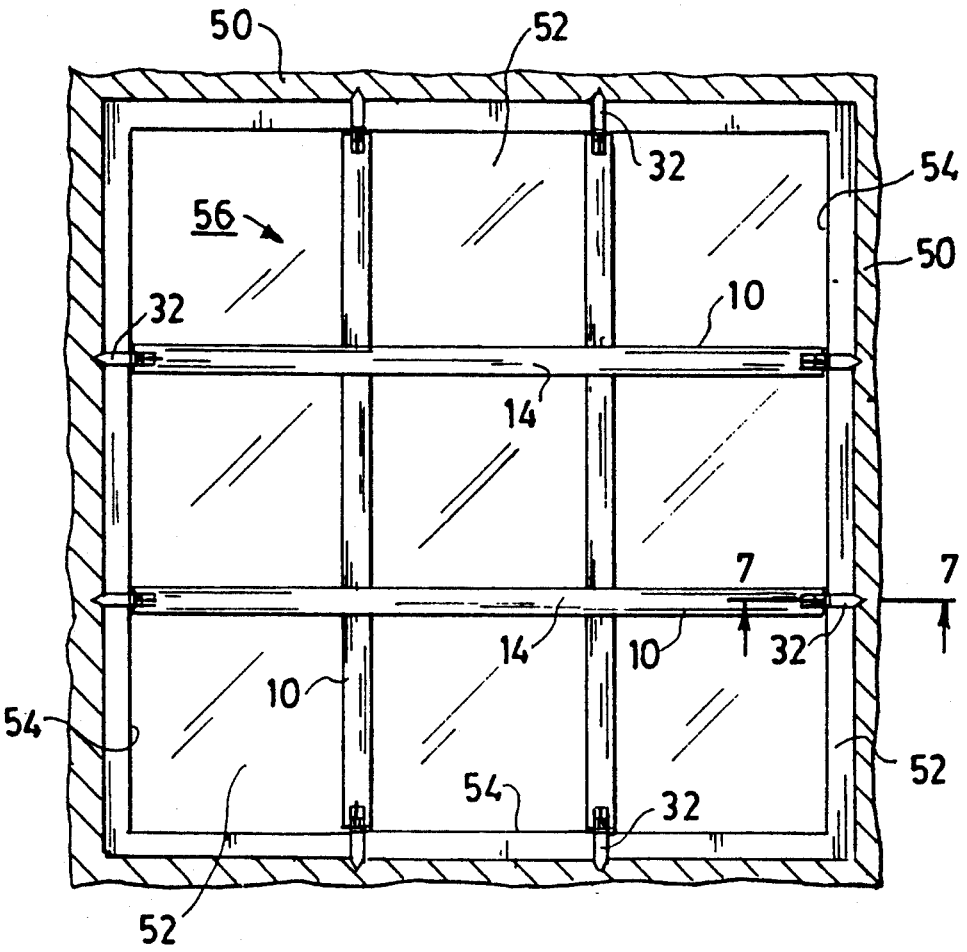
FIG. 6 is a cross-sectional view in a reduced scale through a window sash looking through a windowpane against bottom surfaces of a window grille that is mounted to the sash in accordance with my invention.
Figure 7:
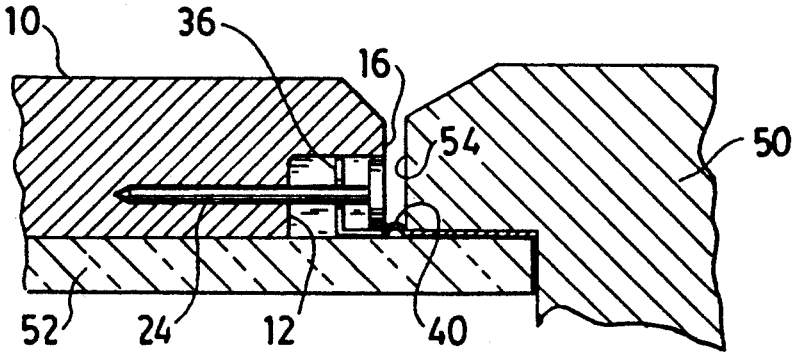
FIG. 7 is an enlarged cross-sectional view in the scale of FIGS. 1 through 5 taken along line 7—7 in FIG. 6 showing a side view of the bracket piece engaged with the nail of attaching the grille to the sash.

The two pieces of my spring clip assembly, namely pin 20 and bracket 30, cooperate as part of my new system for retaining window grilles against panes mounted within window sashes. FIGS. 6 and 7 illustrate details of my retaining system. The view of FIG. 6 is taken from outside of a window through a section of a sash 50 aligned with a windowpane 52.

Embedded between the sash 50 and the windowpane 52 are the blades 32 of my bracket piece. From FIG. 7, it can be seen that the blades 32 are pushed under a portion of sash 50 that overlays the pane 52 until boss 40 of the blade contacts one of the inner wall surfaces 54 of the sash. Thus, the boss 40 functions as a stop for positioning the fingers 36 of the spring clip arm of the bracket at a predetermined distance from the inner wall surfaces 54.

Referring again to FIG. 6, the molding 10 is shown in an interlocking pattern defining a window grille 56 that is located within the inner wall surfaces 54 of the sash. However, not all of the pieces of molding 12 are the same length. As a result, small gaps are apparent between some of the end faces 16 of the molding and the inner wall surfaces 54. These gaps create problems for certain prior window grille retaining systems.

However, in accordance with my invention, the predetermined distance between the fingers 36 of my bracket and the inner wall surfaces 54 exceeds ordinary variations in the lengths of the molding. Further, the slot 12 extends from the end face 16 along the length of the molding through a distance that is equal to or greater than the predetermined distance between the fingers and the inner wall surfaces of the sash. This dimensional relationship allows slot 12 to receive the fingers 36 through a range of positions from the end face 16 of the molding being in contact with the inner wall surfaces 54 to the end face 16 being spaced from the inner wall surfaces 54 at the predetermined distance between the fingers 36 and the boss 40. The particular distance between the point at which the fingers 36 engage the shaft 24 and the end face 16 of the molding is found by subtracting the distance between the end face 16 of the molding and the inner wall surfaces 54 of the sash from the predetermined distance between the fingers and the inner wall surfaces.

Outer edges of the fingers 36 are tapered (see FIG. 4) to help guide the slots 12 over the fingers. Once in the slot 12, the fingers 36 contact the shaft 24 of the pin piece. The slit 38 between the fingers is dimensioned in width significantly less that the diameter of the shaft 24. However, the ends of the fingers are slightly radiused or chamfered to help align the shaft 24 with the slit 38. Further movement of the molding 10 toward the pane 52 separates the fingers 36 and moves the shaft 24 into the slit 38. In a position where the molding 10 contacts the pane 52, the shaft 24 is received between a pair of notches 58 (see again FIG. 4) that are formed in opposing inner edges of the fingers 36. The notches 58 permit the fingers 36 to spring back through at least part of the distance at which they were separated to admit the shaft 24 between them.

Thus, when the window grille 56 is properly positioned against the windowpane 52, the fingers 36 of my brace pieces embrace the shafts 24 of my pin pieces with a snap-type engagement. The fingers 36 also exhibit against the shafts 24 resilient reaction forces that oppose any movement of the molding away from the shafts. The reaction forces are directed in a plane that is occupied by the fingers and extends substantially perpendicular to the length of the molding. Accordingly, the same reaction forces are effective along any portion of the exposed length of the shaft 24 that is engaged by the fingers.

My invention can also be practiced as a method for installing window grilles. The first step is to form, in the bottom surface 14 of the molding, the slots 12 that extend from the end faces 16 along a predetermined length of the molding. Any conventional means may be used to form the slots 12 including boring, routing, and cutting. Pin pieces 20 are inserted into the molding through the end faces 16 in positions that center the pin pieces within the slots. Nails may be used as pin pieces to provide heads 22 against which the shafts 24 of the nails ma be driven into the molding.

The bracket piece 30 may be stamped out of sheet metal forming a blade arm and a spring clip arm. The blade arm is formed as a blade 32 having a pointed end 34. Part way along the length of the blade 32 a boss 40 is formed. The spring clip arm is formed as two fingers 36 separated by a slit 38. Outer edges of the two fingers 36 are tapered, and the ends of the two fingers next to the sides of the slit are radiused. Notches 58 are formed in opposing inner edges of the fingers. Conventional die cutting practices may be used to form all of the just-mentioned features in the bracket piece 30.

The blades 32 of the brackets are aligned with desired intersections between the window grille molding 56 and sash 50, and the blades are pushed between the sash 50 and windowpane 52 until the bosses 40 of the blades contact the inner wall surfaces 54 of the sash. However, instead of forming a boss in the blade 32, it would also be possible to use a tool as a spacer between the spring clip arm and inner wall surfaces 54 of the sash to position the spring clip arm at a predetermined distance from the inner wall surfaces. Finally, ends of the window grille molding 56 are pushed toward the pane 52 until the the two fingers 36 of the bracket piece positively interlock with the shaft 24 of the pin piece with a snap-type engagement.

The amount of resilience between the fingers 36 for engaging the pin pieces 20 may be controlled in a variety of ways including the selection of materials having different thicknesses or resilient characteristics for making the brace pieces. However, it is important to limit the amount of resilience to permit my spring clip assembly to be unsnapped in response to a predetermined manual separating force directed away from the windowpane.

Figure 8:
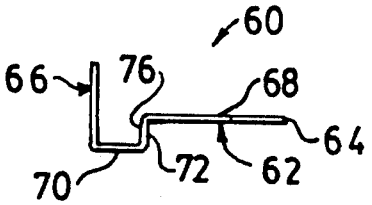
FIG. 8 is a side view of an alternative bracket piece showing a blade arm with two parallel portions that are offset with respect to each other.
Figure 9:
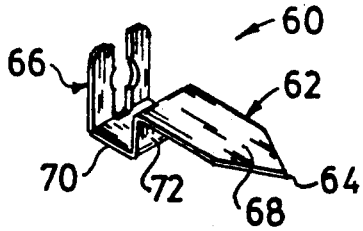
FIG. 9 is a perspective view of the alternative bracket piece showing both arms of the piece.
Figure 10:
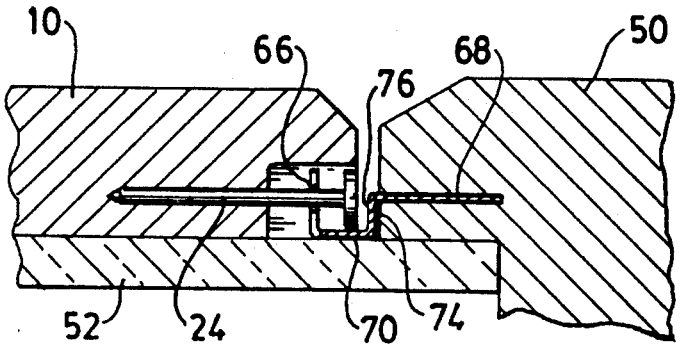
FIG. 10 is a cross-sectional view similar to FIG. 7 showing a side view of the alternative bracket piece engaged with the nail for attaching the grille to the sash.

An alternative bracket piece 60 is illustrated by FIGS. 8–10. Similar to the bracket 30, the alternative bracket 60 is also made of a resilient material and is bent at a right angle for dividing the bracket into two arms. One of the arms 62 is formed as a blade having a pointed end 64, and the other arm 66 is formed as a spring clip.

The spring clip arm 66 is similar to the spring clip arm of the bracket 30. However, the blade arm 62 is bent in two places to offset different portions of the arm. A first portion 68 of the blade arm carries the pointed end 64 for penetrating the sash 50, a second portion 70 of the blade arm is joined to the spring clip arm 66 at a first right angle bend, and a third portion 72 of the blade arm is joined to the first and second portions 68 and 70 at respective second and third right angle bends.

The second and third right angle bends orient the first and second portions 68 and 70 parallel to each other. The third portion 72 is oriented parallel to the spring clip arm 66 and perpendicular to the first and second portions 68 and 70. The length of the third portion 72 is set to offset the first and second portions 68 and 70 through a predetermined spacing that is preferably between 1.5 millimeters and 3 millimeters.

FIG. 10 shows how the second portion 70 of the blade arm guides the first portion 68 into engagement with the window sash 50 at a predetermined spacing from the windowpane 52. The spacing is sufficient to guide the pointed end 64 of the blade arm above any glazing material between the window sash 50 and windowpane 52 and into engagement with the window sash. However, the spacing is limited to avoid engaging sash faces that depart significantly from perpendicular to the windowpane 52.

An inner face 74 of the third portion 72 of the blade arm forms a stop for limiting penetration of the first portion 68 into the sash. An outer face 76 of the same portion provides a bearing surface for a tool to urge the first portion 60 into engagement with the sash. In addition, the third portion 72 is spaced from the spring clip arm 66 similar to the spacing of the boss 40 from the spring clip arm of the previous embodiment to accommodate variations in the length of the grille molding 10.

Figure 11:
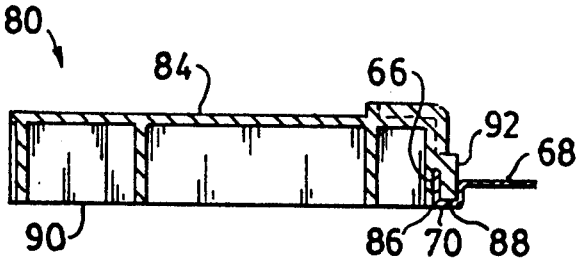
FIG. 11 is a cross-sectional side view through the installation tool showing the alternative bracket piece engaged with the tool.
Figure 12:
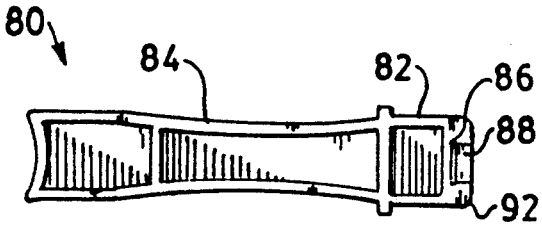
FIG. 12 is a bottom view of a tool for installing the alternative bracket piece.

The remaining drawing figures, FIGS. 11 and 12, illustrate a novel tool 80 that is specially designed for installing the alternative bracket 60 in window sashes. The tool 80, which can be molded from a resin material, includes a head portion 82 and a grip portion 84.

The head portion 82 includes a slot 86 for receiving the spring clip arm 66 and a recess 88 formed in a bottom surface 90 for receiving the second portion 70 of the blade arm flush with the bottom surface 90. A front face 92 of the tool is spaced from the slot 86 to provide a bearing surface for engaging the outer face 76 of the third portion of the blade arm. Friction between the outer face 76 of the third portion of the blade arm and the front face 92 of the tool, as well as between the spring clip arm 66 and the slot 86, holds the alternative bracket in position with respect to the tool for installing the bracket in the window sash.

Once the alternative bracket is secured to the tool, the bottom surface 90 of the tool can be guided along the windowpane for moving the pointed end 64 of the bracket to a desired location for mounting the bracket in the sash at a predetermined spacing above the pane. The grip portion 84 of the tool is shaped to receive a force for urging the first portion 68 of the blade arm into engagement with the window sash 50. The force is transmitted through the front face 92 of the tool to the outer face 76 of the third portion of the blade arm. The first portion 68 of the blade arm penetrates the window sash until the inner face 74 of the third portion contacts the sash. The third portion of the blade arm also provides clearance with the sash for removing the tool from the installed bracket.

I claim:

1. A window grille retaining system comprising:

molding for forming a pattern defining a window grille dimensioned in length to fit within a window sash with end faces of said molding adjacent to inner wall surfaces of the sash and a bottom surface of the molding against a windowpane;

slots formed in said bottom surface of the molding extending from said end faces a predetermined distance along said length of the molding;

spring clip assemblies each having two pieces; one of said pieces is carried by said molding within said slots, and the other of said pieces is bent in the shape of a bracket; and said other piece of the spring clip assemblies including a first arm formed as a blade for anchoring said other piece to the window sash and a second arm formed as a spring clip having two resilient fingers for engaging said first piece within said slots at different distances from said end faces along said length of the molding.

2. The retaining system of claim 1 in which said one piece of the spring clip assemblies is formed as a pin having a portion of its length exposed within said slots through the bottom surface of the molding.

3. The retaining system of claim 2 in which said slit defines a space measured between inner edges of said fingers that is smaller than a diameter of said pin.

4. The retaining system of claim 3 in which opposing notches are formed in said inner edges of said fingers for embracing said pin with a snap-type engagement.

5. The retaining system of claim 4 in which said pin takes the form of a nail having a shaft that is driven through said slot into said molding until a head of the nail is flush with said end faces of the molding.

6. The retaining system of claim 2 in which outer edges of said fingers are tapered to help guide said spring clip arm into said slots.

7. The retaining system of claim 6 in which ends of said fingers are radiused to help guide said pin into said slit between the fingers.

8. The retaining system of claim 1 in which a stop is formed in said blade arm for positioning said spring clip arm at a predetermined distance from the inner wall surfaces of the window sash.

9. The retaining system of claim 8 in which said predetermined distance at which the slots extend from the end faces of the molding is at least as large as a distance from said stop to said spring clip arm.

10. The retaining system of claim 9 in which said different distances from the end faces of the molding at which the two pieces of the spring clip assemblies are engageable correspond to different positions of said end faces of the molding along said distance from the stop to the spring clip arm.

11. The retaining system of claim 1 in which said blade arm includes a first portion that is shaped for engaging the window sash and a second portion that is offset from said first portion for guiding said first portion into engagement with the window sash at a predetermined spacing from the windowpane.

12. The retaining system of claim 11 in which said first and second portions of the blade arm are joined by a third portion that forms a stop for limiting penetration of said first portion into the window sash.

13. The retaining system of claim 12 in which said first and second portions of the blade arm are oriented substantially parallel to each other.

14. A window grille retaining system for accommodating variations in the lengths of molding pieces forming a grille in which end faces of the molding pieces are positioned at different distances from inner wall surfaces of a window sash comprising:

slots formed in a bottom surface of the molding extending from the end faces of the molding a predetermined distance along the length of the molding;

spring clip assemblies each having two pieces; one of said pieces is carried by said molding within said slots, and the other of said pieces includes a first arm for anchoring said other piece to the window sash and a second arm for engaging said first piece within said slots;

means for positioning said second arm with respect to the inner wall surfaces of the window sash at a predetermined distance that is at least as large as the largest of the different distances at which the end faces of the molding are spaced from the inner wall surfaces of the window sash;

said two pieces of the spring clip assemblies being engageable at different distances from the end faces of the molding corresponding to the distance between the end faces of the molding and the inner wall surfaces of the window sash subtracted from said predetermined distance between the second arm of the other piece of the spring clip assemblies and the inner wall surfaces of the window sash;

said two pieces exerting a resilient reaction force opposing their separation directed in a plane that extends substantially perpendicular to said length of the molding;

said first arm of the other piece being formed as a blade; and said means for positioning said second arm with respect to the inner wall surfaces of the window sash being formed in said blade arm as a bend that extends across the blade arm and functions as a stop against the inner wall surfaces of the window sash.

15. The retaining system of claim 14 in which said second arm of the other piece is formed as a spring clip having two resilient fingers separated by a slit.

16. The retaining system of claim 15 in which said one piece of the spring clip assemblies is formed as a pin having a portion of its length exposed within said slots through said bottom surface of the molding.

17. The retaining system of claim 16 in which said slit defines a space measured between inner edges of said fingers that is smaller than a diameter of said pin.

18. The retaining system of claim 17 in which opposing notches are formed in said inner edges of said fingers for embracing said pin with a snap-type engagement.

19. The retaining system of claim 18 in which said two pieces of the spring clip assemblies are unsnapped by a predetermined manual force directed away from the windowpane.

20. The retaining system of claim 14 in which said blade arm of the other piece includes a first portion that is shaped for engaging the window sash and a second portion that is offset from said first portion for guiding said first portion into engagement with the inner wall surfaces of the window sash at a predetermined spacing from a windowpane supported within the window sash.

21. The retaining system of claim 20 in which said first and second portions of the blade arm are joined by a third portion that functions as the stop for limiting penetration of said first portion through the inner wall surfaces of the window sash.

22. The retaining system of claim 21 in which said first and second portions of the first arm are oriented substantially parallel to each other and to the windowpane.

23. In a retaining clip for mounting a window grille within a window sash on one side of a windowpane including:

a body of resilient material bent in the shape of a bracket;

a first arm of said bracket arranged for anchoring the clip to the window sash, and a second arm of said bracket arranged for engaging the window grille; the improvement in which:

said first arm includes a first portion that is shaped for engaging the window sash and a second portion that is offset from said first portion for guiding said first portion into engagement with the window sash at a predetermined spacing from the windowpane.

24. The clip of claim 23 in which said first and second portions of the first arm are joined by a third portion that forms a stop for limiting penetration of said first portion into the window sash.

25. The clip of claim 24 in which said third portion of the first arm is separated from said second arm for spacing said second arm at a predetermined distance from the window sash.

26. The clip of claim 25 in which said first and second portions are offset through a distance between 1.5 millimeters and 3 millimeters.

27. The clip of claim 24 in which a first bend is formed in said body of resilient material for orienting said second portion of the first arm with respect to said second arm, a second bend is formed in said body of resilient material for orienting said second portion with respect to said third portion, and a third bend is formed in said body of resilient material for orienting said first portion with respect to said third portion.

28. The clip of claim 27 in which said first and second portions of the first arm are oriented substantially parallel to each other.

29. The clip of claim 28 in which said third portion of the first arm extends substantially perpendicular to said first and second portions for providing a face against which the first arm can be urged into engagement with the window sash.

30. The clip of claim 23 in which said second arm is formed as a spring clip having two resilient fingers separated by a slit.

31. The clip of claim 30 in which opposing notches are formed along inner edges of said fingers for embracing a pin with a snap-type engagement.

32. The clip of claim 31 in which outer edges of said fingers are tapered to help guide said second arm into slots formed in the window grille.

* * * * *